US005622799A

United States Patent [19]

Suzuki et al.

[11] Patent Number: 5,622,799

[45] Date of Patent: Apr. 22, 1997

[54] ELECTROPHOTOGRAPHIC PHOTOSENSITIVE MEMBER, PROCESS CARTRIDGE AND ELECTROPHOTOGRAPHIC APPARATUS HAVING THE ELECTROPHOTOGRAPHIC PHOTOSENSITIVE MEMBER

[75] Inventors: Koichi Suzuki; Hideyuki Takai, both of Yokohama; Satomi Sugiyama; Mitsuhiro Kunieda, both of Kawasaki, all of Japan

[73] Assignee: Canon Kabushiki Kaisha, Tokyo, Japan

[21] Appl. No.: 345,702

[22] Filed: Nov. 21, 1994

[30] Foreign Application Priority Data

Nov. 22, 1993 [JP] Japan ..... 5-314054

[51] Int. Cl.[6] ..... G03G 5/06; G03G 5/047

[52] U.S. Cl. ..... 430/58; 430/72; 430/76; 430/78; 430/79; 430/83; 399/159

[58] Field of Search ..... 430/58, 72, 76, 430/78, 79, 83; 355/211

[56] References Cited

U.S. PATENT DOCUMENTS

| | | | |
|---|---|---|---|
| 4,994,338 | 2/1991 | Takai | 430/76 |
| 5,229,237 | 7/1993 | Kawamorita et al. | 430/58 |
| 5,356,746 | 10/1994 | Sugiyama et al. | 430/73 |

FOREIGN PATENT DOCUMENTS

| | | |
|---|---|---|
| 0034497 | 8/1981 | European Pat. Off. . |
| 56-116040 | 9/1981 | Japan . |
| 61-231052 | 10/1986 | Japan . |
| 62-267363 | 11/1987 | Japan . |
| 63-264762 | 11/1988 | Japan . |

OTHER PUBLICATIONS

Database WPI, Week 9313, Derwent, AN93–105169.
Database WPI, Week 9317, Derwent, AN93–137475.
Database WPI, Week 9223, Derwent, AN92–187655.
Database WPI, Week 9409, Derwent, AN94–068879.

*Primary Examiner*—Roland Martin
*Attorney, Agent, or Firm*—Fitzpatrick, Cella, Harper & Scinto

[57] ABSTRACT

An electrophotographic photosensitive member, a process cartridge having the electrophotographic photosensitive member and an electrophotographic apparatus are provided. The electrophotographic photosensitive member has a conductive substrate and a photosensitive layer thereon, wherein the photosensitive layer contains a disazo pigment represented by the following formula (1):

(1)

wherein $R_1$ to $R_8$ are the same or different and are each a hydrogen atom, a halogen atom, an alkyl group or an alkoxy group, n is a positive integer, $A_1$ and $A_2$ are the same or different and are each a coupler residual group having a phenolic hydroxyl group, and at least one of $A_1$ and $A_2$ is a coupler residual group represented by the following formula (2):

(2)

wherein $X_1$ is a residual group forming a polycyclic aromatic ring or a heterocyclic ring by condensing with a benzene ring, $R_9$ and $R_{10}$ are the same or different and are each a hydrogen atom, an alkyl group, an aryl group, an aralkyl group, a heterocyclic group or a residual group forming a cyclic amino group by bonding together, and $Z_1$ is an oxygen atom or a sulfur atom.

8 Claims, 1 Drawing Sheet

ELECTROPHOTOGRAPHIC PHOTOSENSITIVE MEMBER, PROCESS CARTRIDGE AND ELECTROPHOTOGRAPHIC APPARATUS HAVING THE ELECTROPHOTOGRAPHIC PHOTOSENSITIVE MEMBER

BACKGROUND OF THE INVENTION

1. Field of the Invention

The present invention relates to an electrophotographic photosensitive member, and more particularly to an electrophotographic photosensitive member comprising a photosensitive layer containing a disazo pigment having a specific structure, and to a process cartridge and an electrophotographic apparatus having the electrophotographic photosensitive member.

2. Related Background Art

Electrophotographic photosensitive members having an organic photoconductive materials have advantages in that their productivity is satisfactory, their cost can be reduced relatively and their color sensitivity can desirably be controlled by adequately selecting the pigment or dye used. Therefore, various studies of such electrophotographic photosensitive members has been carried out. In particular, a function-separated-type photosensitive member has been developed by which poor sensitivity and unsatisfactory durability that have been experienced with the conventional organic electrophotographic photosensitive member can be overcome. The foregoing function-separated-type photosensitive member has a charge generating layer which contains charge generating materials, such as an organic photoconductive pigment and dye, and a charge transporting layer which contains charge transporting materials, such as photoconductive polymers and low-molecular weight organic photoconductive materials.

The azo pigments have, among the organic photoconductive materials, excellent photoconductivity and various kinds of them can be relatively easily obtained by combining amine components and coupler components. Therefore, various pigments have been disclosed, for example, in Japanese Patent Laid-Open No. 56-116040, Japanese Patent Laid-Open No. 61-231052, Japanese Patent Laid-Open No. 62-267363, and Japanese Patent Laid-Open No. 63-264762.

In recent years, however, there have been demands for higher image quality and more excellent durability. To meet these demands, electrophotographic photosensitive members having higher sensitivity, more excellent electrophotographic characteristics, even when repeatedly used and having excellent environment stability have been desired.

SUMMARY OF THE INVENTION

Accordingly, an object of the present invention is to provide an electrophotographic photosensitive member having excellent sensitivity.

Another object of the present invention is to provide an electrophotographic photosensitive member having stable and excellent potential characteristics even after repeated use or use in a variety of environments.

Another object of the present invention is to provide a process cartridge and an electrophotographic apparatus having the foregoing electrophotographic photosensitive member.

According to one aspect of the present invention, there is provided an electrophotographic photosensitive member comprising:

a conductive substrate and a photosensitive layer thereon, said photosensitive layer containing a disazo pigment represented by the following formula (1):

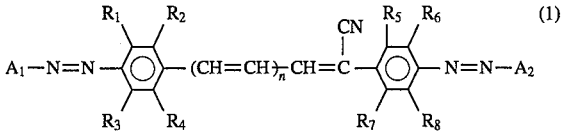

(1)

wherein $R_1$ to $R_8$ are the same or different and are each a hydrogen atom, a halogen atom, an alkyl group or an alkoxy group, n is a positive integer, $A_1$ and $A_2$ are the same or different and are each a coupler residual group having a phenolic hydroxyl group, and at least one of $A_1$ and $A_2$ is a coupler residual group represented by the following formula (2):

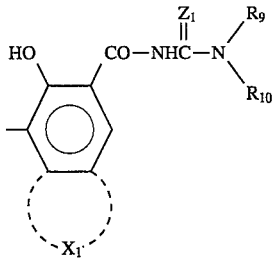

(2)

wherein $X_1$ is a residual group forming a polycyclic aromatic ring or a heterocyclic ring by condensing with a benzene ring, $R_9$ and $R_{10}$ are the same or different and are each a hydrogen atom, an alkyl group, an aryl group, an aralkyl group, a heterocyclic group or a residual group forming a cyclic amino group by bonding together, and $Z_1$ is an oxygen atom or a sulfur atom.

According to another aspect of the present invention, there is provided a process cartridge and an electrophotographic apparatus having the foregoing electrophotographic photosensitive member.

DESCRIPTION OF THE PREFERRED EMBODIMENTS

Figure 1:
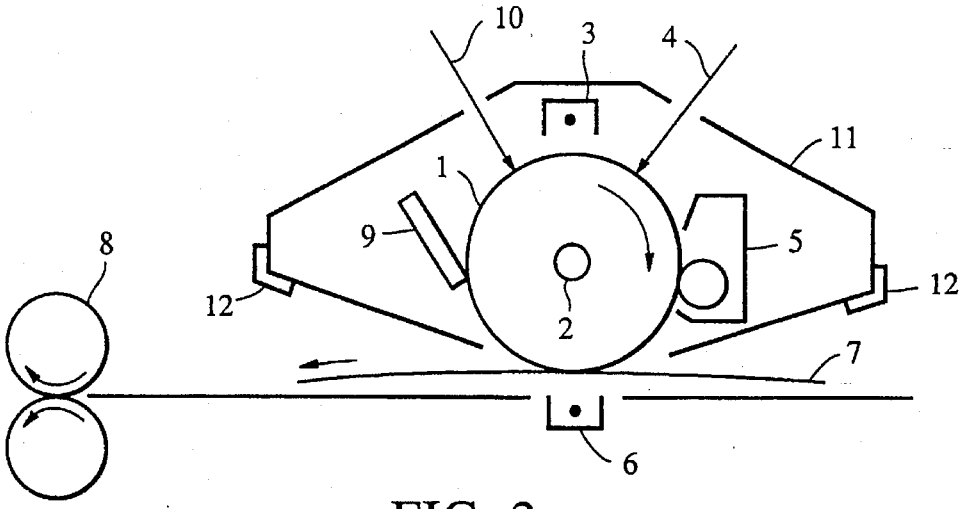
FIG. 1 is a schematic view which illustrates the structure of an electrophotographic apparatus having a process cartridge including an electrophotographic photosensitive member according to the present invention.

An electrophotographic photosensitive member according to the present invention has a photosensitive layer containing a disazo pigment represented by the following formula (1):

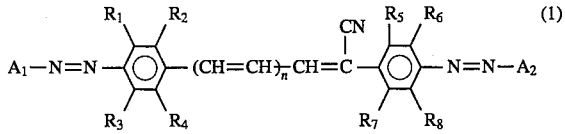

(1)

wherein $R_1$ to $R_8$ are the same or different and are each a hydrogen atom, a halogen atoms, an alkyl groups or an alkoxy groups, n is a positive integer, $A_1$ and $A_2$ are the same or different and are each a coupler residual group having a phenolic hydroxyl group, and at least one of $A_1$ and $A_2$ is a coupler residual group represented by the following formula (2)

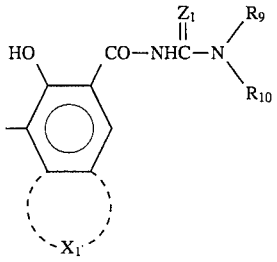

(2)

wherein $X_1$ a residual group forming a polycyclic aromatic ring or a heterocyclic ring by condensing with a benzene ring, $R_9$ and $R_{10}$ are the same or different and are each a hydrogen atom, an alkyl group, an aryl group, an aralkyl group, an heterocyclic group or a residual group forming a cyclic amino group by bonding together, and $Z_1$ is an oxygen atom or a sulfur atom.

The halogen atom represented by $R_1$ to $R_8$ is exemplified by fluorine atom, chlorine atom, bromine atom and iodine atom. The alkyl group is exemplified by methyl, ethyl and propyl group. The alkoxy group is exemplified by methoxy, ethoxy and propoxy group. It is preferable that $R_1$ to $R_8$ are hydrogen atoms. Furthermore, it is preferable that n, which is a positive integer and not less than 1, is an integer from 1 to 6.

$A_1$ and $A_2$ are each a coupler residual group having a phenolic hydroxyl group. The coupler residual group is a group corresponding to a part of a coupler component bonding an azo group by a coupling of a disazo component and the coupler component in order to synthesize a disazo pigment. In the present invention, at least one of $A_1$ and $A_2$ is a coupler residual group represented by the formula (2). In the formula (2), the polycyclic aromatic ring represented by $X_1$ and formed by condensing with benzene rings is exemplified by a naphthalene ring and an anthracene ring, while the heterocyclic ring may be a carbazole ring, benzocarbazole ring or dibenzocarbazole ring. The alkyl group represented by $R_9$ and $R_{10}$ is exemplified by methyl group, ethyl group and propyl group. The aryl group is exemplified by phenyl group, naphthyl group and anthryl group. The aralkyl group is exemplified by benzyl group and phenethyl group. The heterocyclic group is exemplified by pyridyl group, trienyl group, thiazolyl group, carbazolyl group, benzoimidazolyl group and benzothiazolyl group. The cyclic amino group is exemplified by pyrrolyl group, indolyl group, carbazolyl group, imidazolyl group, benzoimidazolyl group, pyrazolyl group, phenothiazinyl group and phenoxyazinyl group.

$R_1$ to $R_{10}$ and $X_1$ may have one or more substituents exemplified by an alkyl group such as methyl group, ethyl group or propyl group; an alkoxy group such as methoxy group, ethoxy group or propoxy group; a halogen atom such as fluorine atom, chlorine atom, bromine atom or iodine atom; an acyl group such as acetyl group or benzoyl group; an alkyl amino group such as dimethyl amino group or diethyl amino group; a phenyl carbamoyl group; a nitro group; a cyano group and a halomethyl group such as a trifluoromethyl group.

It is more preferable that both $A_1$ and $A_2$ are the coupler residual groups represented by formula (2). When only one of $A_1$ and $A_2$ is the coupler residual group represented by formula (2), another may be any type of coupler residual groups having phenolic hydroxyl groups, but it is preferable that another is a coupler residual group represented by any one of the following formula (3) to (8).

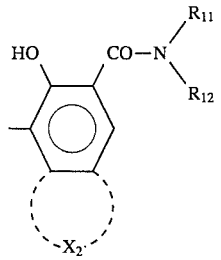

(3)

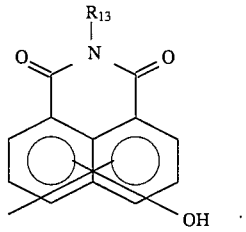

(4)

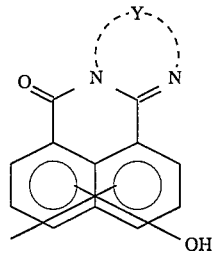

(5)

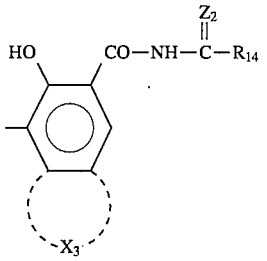

(6)

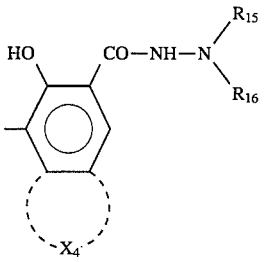

(7)

-continued

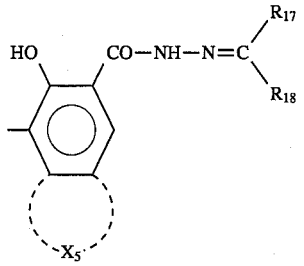

(8)

$X_2$ to $X_5$ in formulas (3), (6) , and (7) and (8) are each a residual group forming a polycyclic aromatic ring or a heterocyclic ring by condensing with a benzene ring. The polycyclic aromatic ring is exemplified by a naphthalene ring and an anthracene ring, while the heterocyclic ring may be a carbazole ring, a benzocarbazole ring and a dibenzocarbazole ring.

Y in formula (5) is an arylene group or a bivalent heterocyclic group containing one or more nitrogen atoms in the ring thereof. The arylene group is exemplified by an o-phenylene, an o-naphthylene, a perinaphthylene, and a 1,2-anthrylene group and the bivalent heterocyclic group may be a 3,4-pyrazolediyl, a 2, 3-pyridinediyl, a 4,5-pyridinediyl, a 6,7-indazolediyl or a 6,7-quinolinediyl group.

$R_{11}$, $R_{12}$, $R_{15}$ and $R_{16}$ in formulas (3) and (7) are each a hydrogen atom, an alkyl group, an aryl group, an aralkyl group or a heterocyclic group. $R_{11}$ and $R_{12}$, and $R_{15}$ and $R_{16}$ are each residual group forming a cyclic amino group by bonding together.

$R_{13}$ in formula (4) is an alkyl group, an aryl group, an aralkyl group and a heterocyclic group.

$R_{14}$ in formula (6) is a hydrogen atom, an alkyl group, an aryl group, an aralkyl group or a heterocyclic group.

$R_{17}$ and $R_{18}$ in formula (8) are each a hydrogen atom, an alkyl group, an aryl group, an aralkyl group, a heterocyclic group or a residual group forming a ring group by bonding together.

The foregoing alkyl group is exemplified by a methyl group, an ethyl group and a propyl group. The aryl group is exemplified by a phenyl group, a naphthyl group and an anthryl group. The aralkyl group is exemplified by a benzyl group and a phenetyl group. The heterocyclic group is exemplified by a pyrydyl group, a thienyl group, a thiazolyl group, a carbazolyl group, a benzoimidazolyl group and a benzothiazolyl group. The cyclic amino group is exemplified by a pyrrolyl, an indolyl group, an indolynyl group, an imidazolyl group, pyrazolyl group, a phenothiazynyl group and a phenoxazinyl group. The cyclic group formed by bonding $R_{17}$ and $R_{18}$ is exemplified by a fluorenylidene group, a xanthenylidene group, an anthronylidene group and a hydroindenylidene group.

$X_2$ to $X_5$, Y, and $R_{11}$ to $R_{18}$ may have a substituent exemplified by an alkyl group such as a methyl group, ethyl group or a propyl group; an alkoxy group such as a methoxy group, an ethoxy group or a propoxy group; a halogen atom such as fluorine atom, chlorine atom, bromine atom or iodine atom; an acyl group such as acetyl group or benzoyl group; an alkyl amino group such as dimethyl amino group or diethyl amino group; a phenyl carbamoyl group; a nitro group; a cyano group and a halomethyl group such as trifluroromethyl group.

$Z_2$ in formula (6) is an oxygen atom or a sulfur atom.

Among the disazo pigments employed in the present invention, a disazo pigment, in which $A_1$ and $A_2$ are represented by the formula selected from the group consisting of formulas (2), (3), (6), (7) and (8) and in which $X_1$ to $X_5$ are the coupler residual groups forming the benzocarbazole ring is a preferred charge generating material adapted to semiconductor laser because its sensitivity area includes a near infrared region.

Preferred examples of the disazo pigment employed in the present invention are shown below. Other disazo pigments within formula 1 can also be employed. In the following disazo pigment examples, the basic structure is shown first, followed by n and the structures of the components $A_1$ and $A_2$.

BASIC STRUCTURE

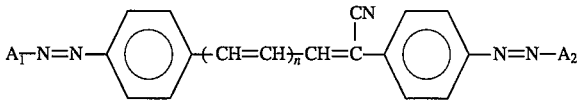

Pigment Example 1 n:1

$A_1$:

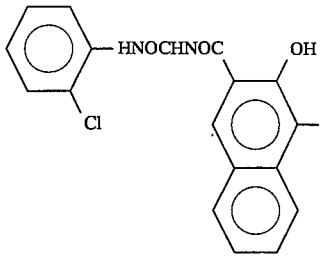

$A_2$:

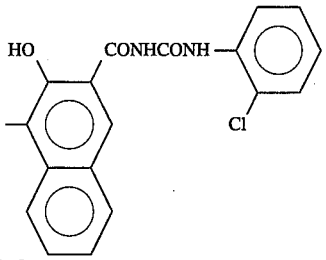

Pigment Example 2 n:1

$A_1$:

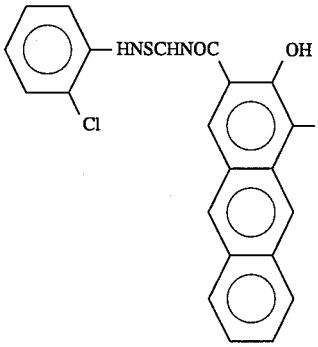

-continued
BASIC STRUCTURE
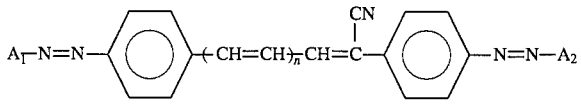
$A_2$:
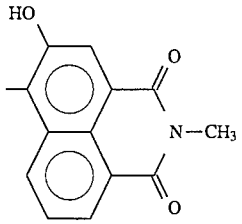
Pigment Example 3
n:1
$A_1$:
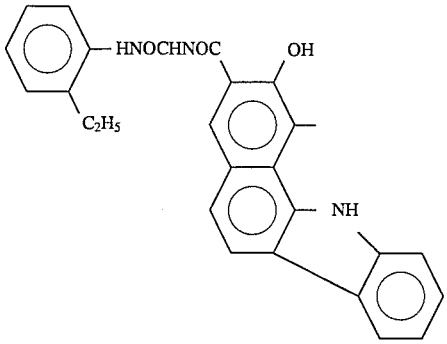
$A_2$:
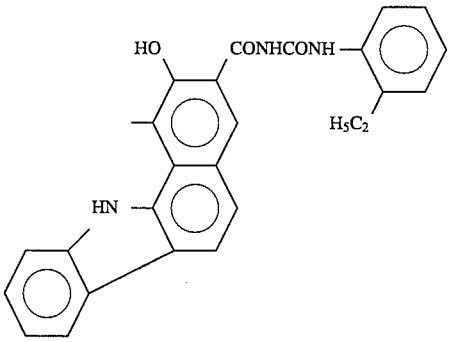
-continued
BASIC STRUCTURE
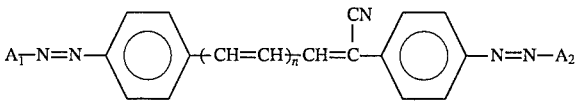
Pigment Example 4
n:1
$A_1$:
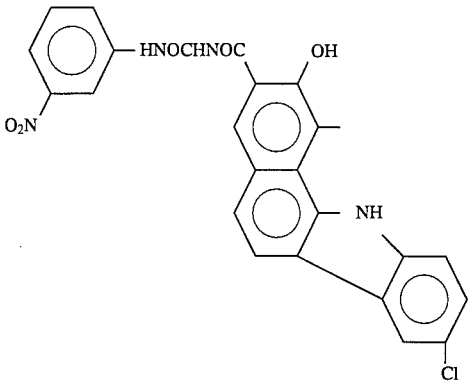
$A_2$:
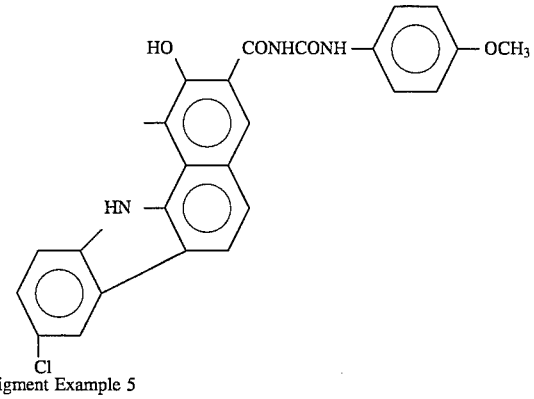
Pigment Example 5
n:1
$A_1$:
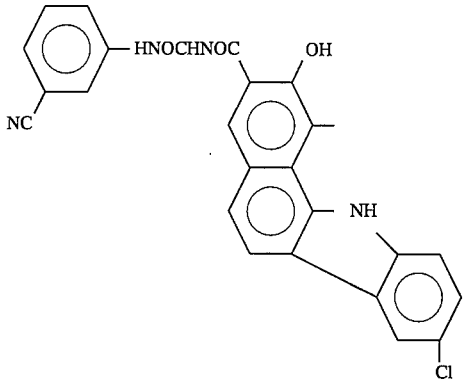

-continued
BASIC STRUCTURE
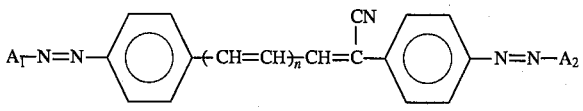
$A_2$:
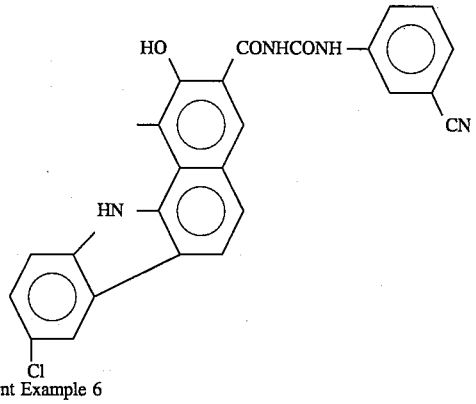
Pigment Example 6
n:2
$A_1$:
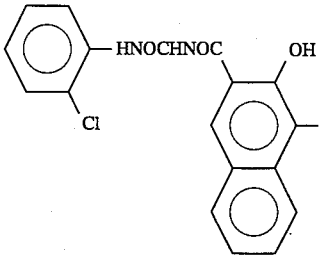
$A_2$:
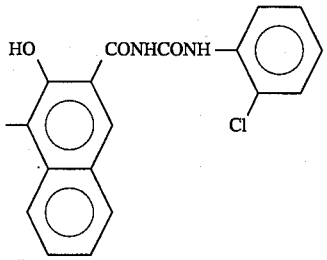
Pigment Example 7
n:2
$A_1$:
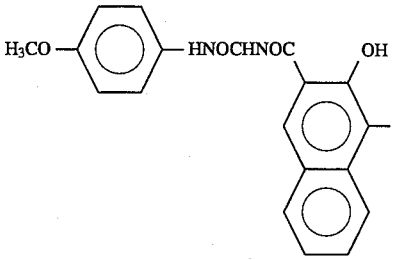
-continued
BASIC STRUCTURE
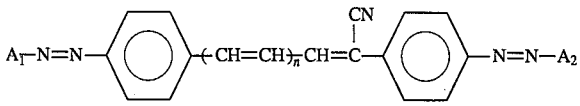
$A_2$:
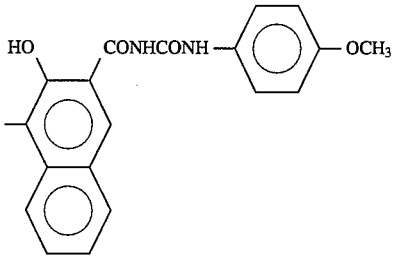
Pigment Example 8
n:2
$A_1$:
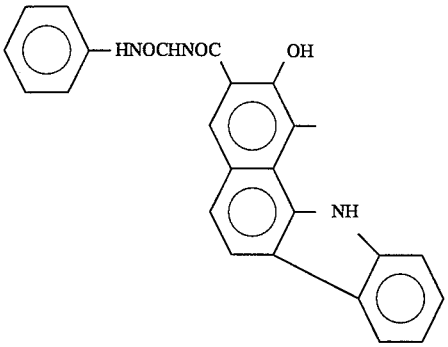
$A_2$:
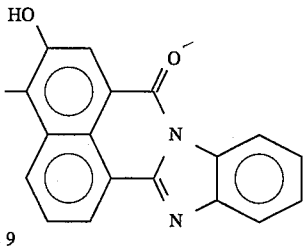
Pigment Example 9
n:2
$A_1$:
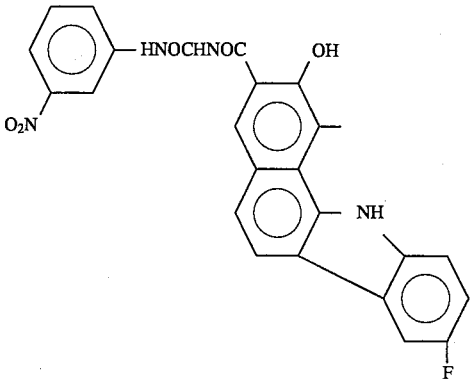

BASIC STRUCTURE
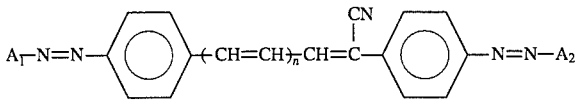
$A_2$:
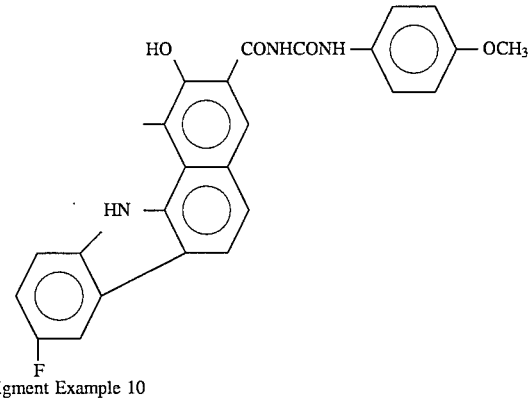
Pigment Example 10
n:2
$A_1$:
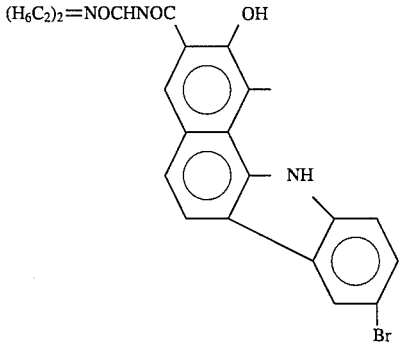
$A_2$:
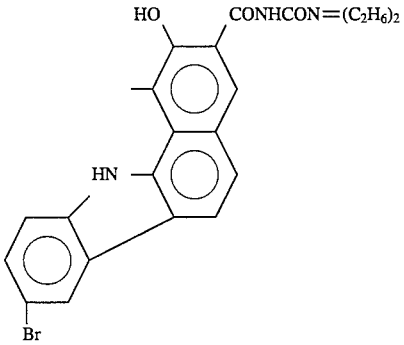
BASIC STRUCTURE
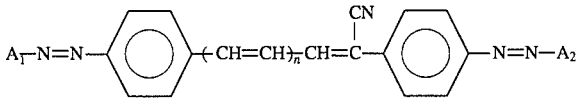
Pigment Example 11
n:2
$A_1$:
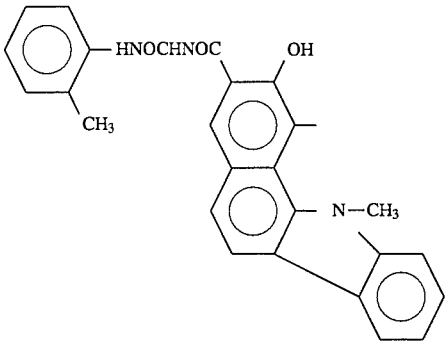
$A_2$:
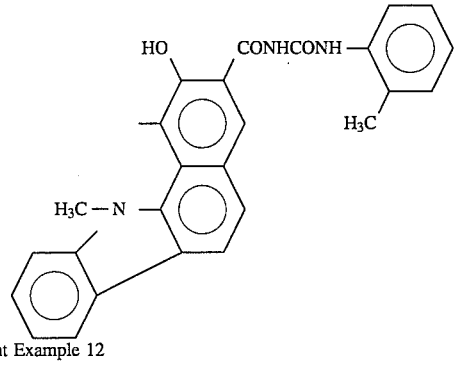
Pigment Example 12
n:2
$A_1$:
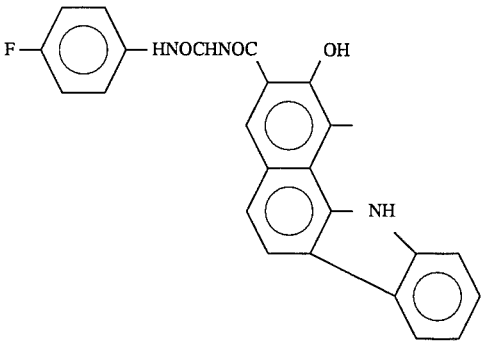

BASIC STRUCTURE
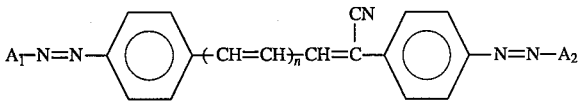
$A_2$:
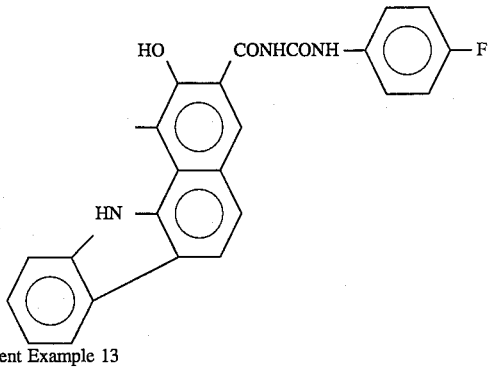
Pigment Example 13
n:2
$A_1$:
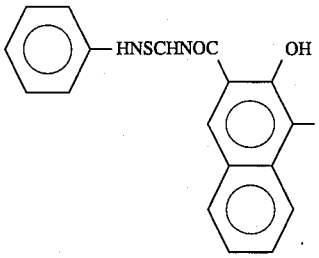
$A_2$:
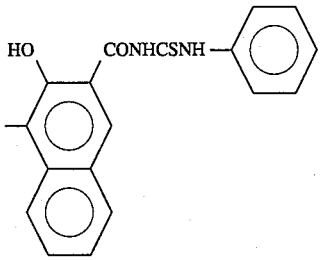
Pigment Example 14
n:2
$A_1$:
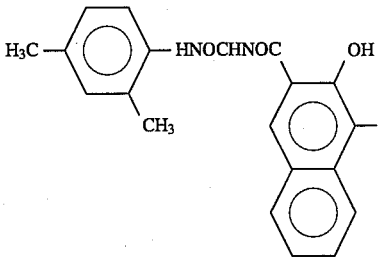
BASIC STRUCTURE
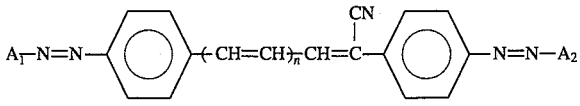
$A_2$:
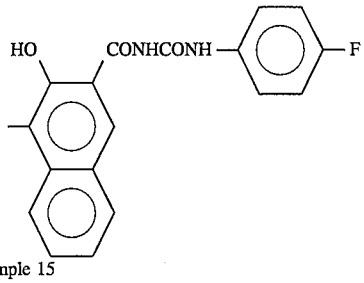
Pigment Example 15
n:3
$A_1$:
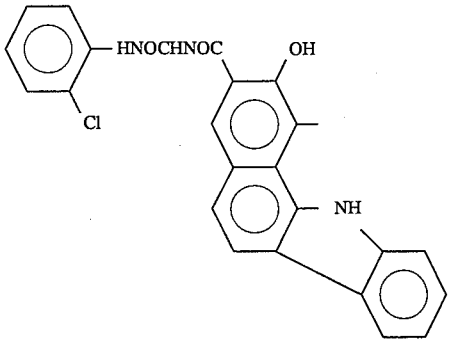
$A_2$:
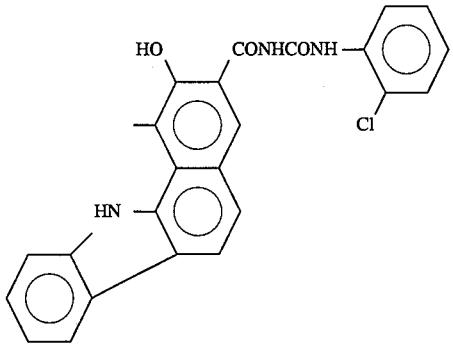

-continued
BASIC STRUCTURE
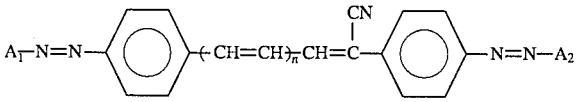
Pigment Example 16
n:3
$A_1$:
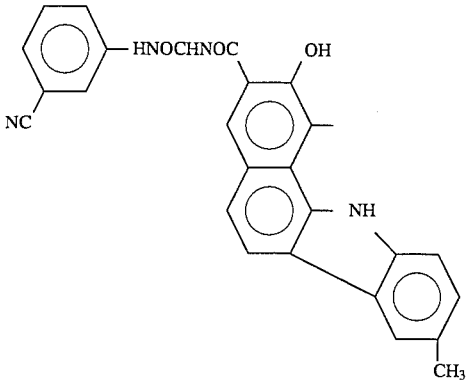
$A_2$:
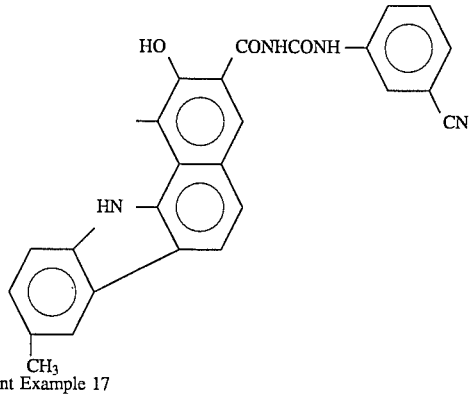
Pigment Example 17
n:3
$A_1$:
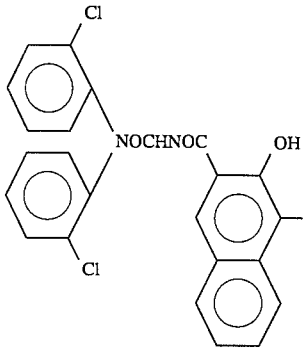
-continued
BASIC STRUCTURE
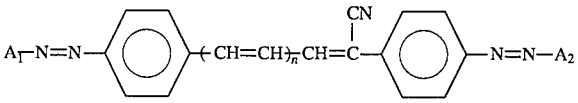
$A_2$:
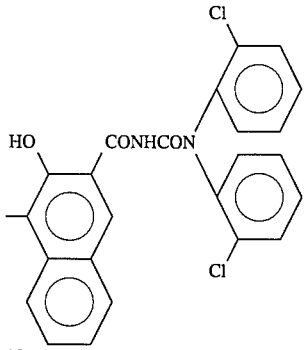
Pigment Example 18
n:4
$A_1$:
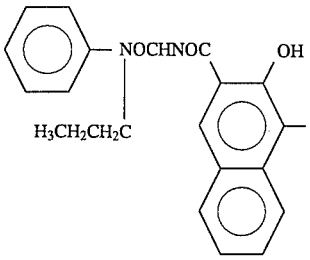
$A_2$:
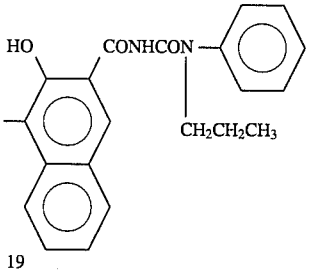
Pigment Example 19
n:4
$A_1$:
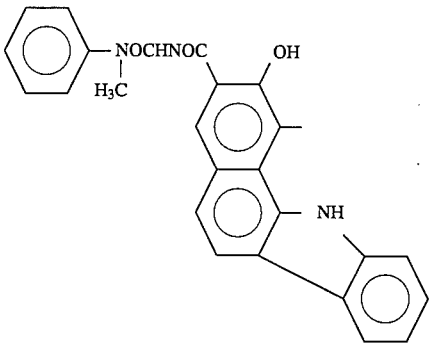

-continued
BASIC STRUCTURE
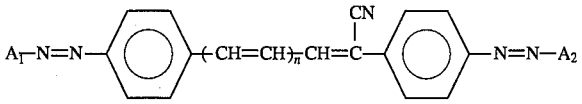
$A_2$:
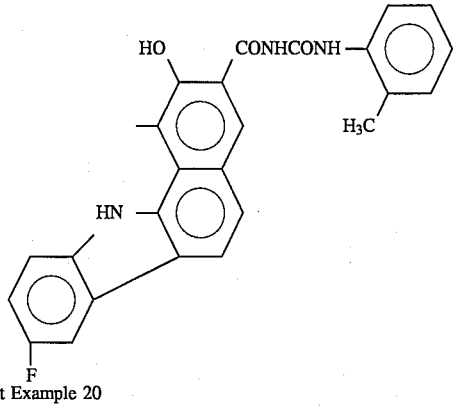
Pigment Example 20
n:4
$A_1$:
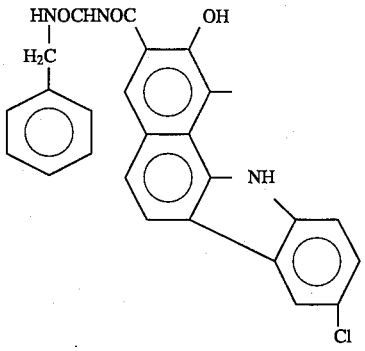
$A_2$:
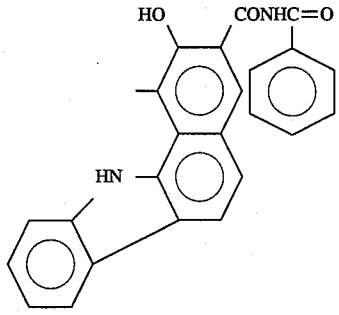
-continued
BASIC STRUCTURE
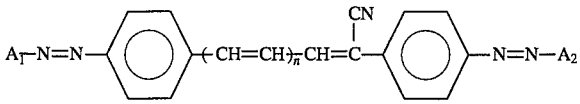
Pigment Example 21
n:4
$A_1$:
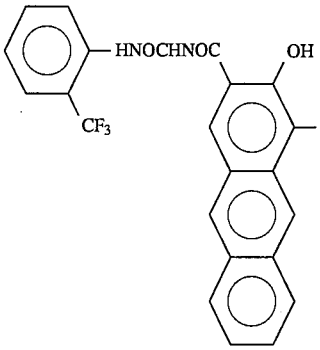
$A_2$:
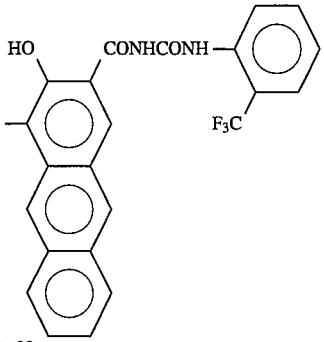
Pigment Example 22
n:5
$A_1$:
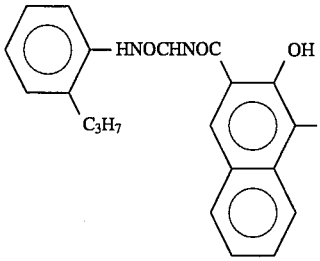

-continued
BASIC STRUCTURE
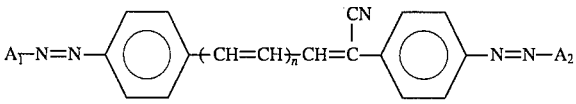
$A_2$:
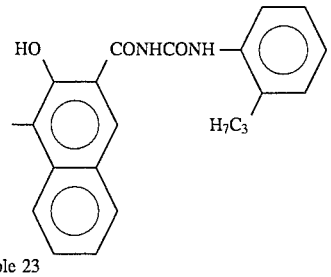
Pigment Example 23
n:5
$A_1$:
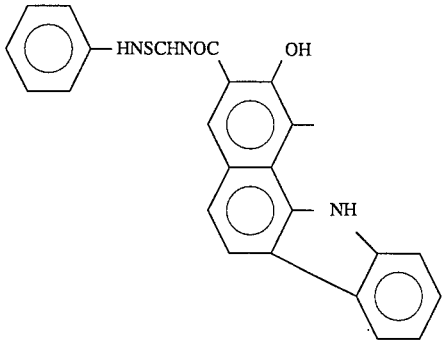
$A_2$:
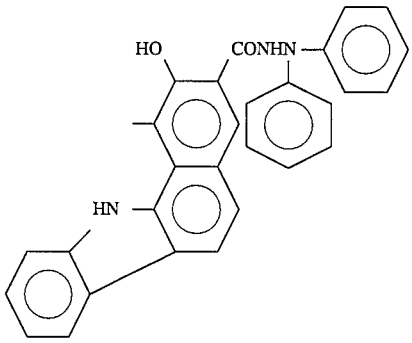
-continued
BASIC STRUCTURE
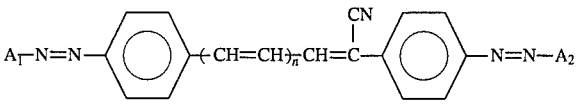
Pigment Example 24
n:5
$A_1$:
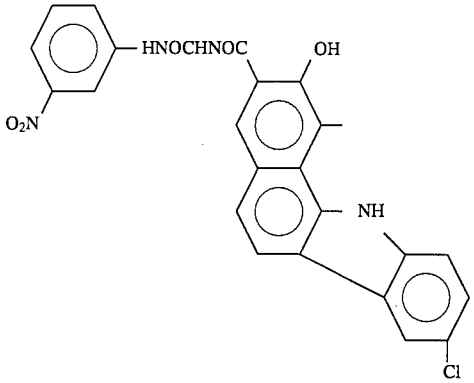
$A_2$:
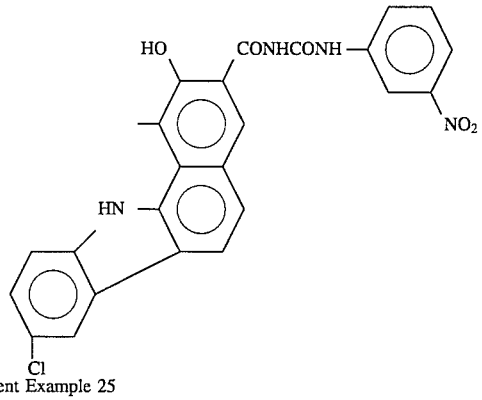
Pigment Example 25
n:6
$A_1$:
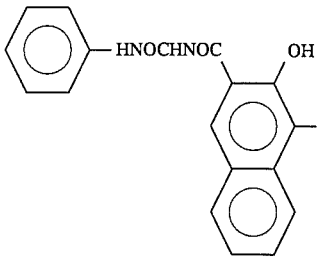

BASIC STRUCTURE

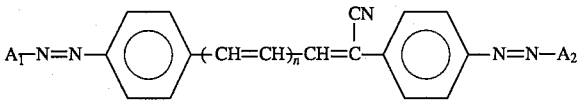

$A_2$:

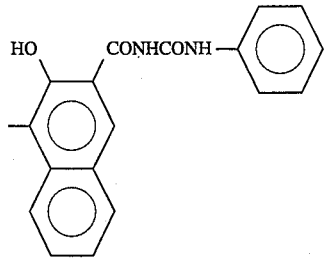

Pigment Example 26 n:6

$A_1$:

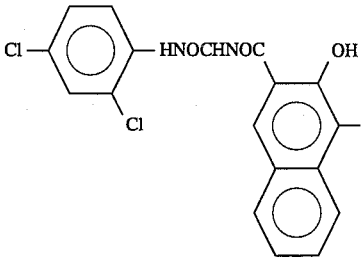

$A_2$:

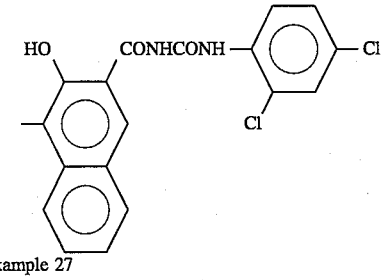

Pigment Example 27 n:6

$A_1$:

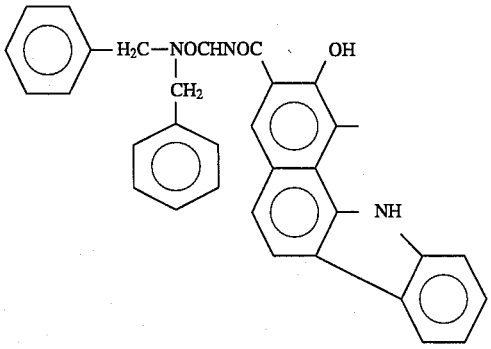

BASIC STRUCTURE

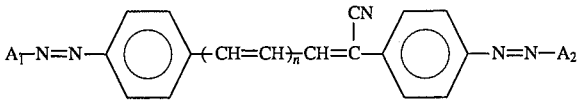

$A_2$:

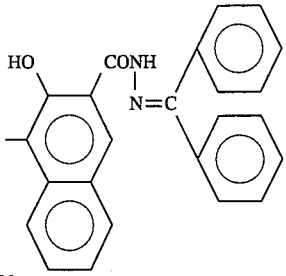

Pigment Example 28 n:6

$A_1$:

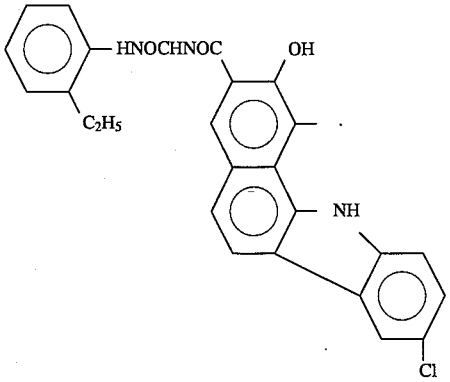

$A_2$:

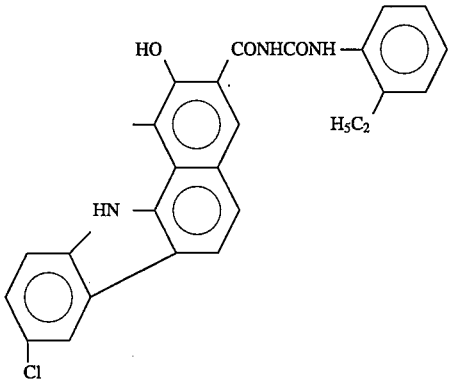

The disazo pigment represented by formula (1) can easily be prepared by (a) reacting a corresponding diamine by conventional methods to form a tetrazonium salt. Suitable reaction methods include (a) use of an alkali, coupled with a coupler in an aqueous solution or (b) converting a tetrazonium salt into a borofluoride salt or a double salt of zinc chloride and then coupling with a coupler in the presence of a base such as sodium acetate or N-methylmorpholine in an organic solution such as N,N-dimethylformamide or dimethylsulfooxide. In the case where a disazo pigment containing $A_1$ and $A_2$ that are different coupler residual groups is prepared, (a) one mole of one coupler is coupled with one mole of the tetrazonium salt, and then one mole of the other coupler is coupled or (b) one mole each of the two kinds of couplers are mixed and the mixture is coupled with a tetrazonium salt.

EXAMPLE OF PREPARATION OF PIGMENT
EXAMPLE 1

150 ml of water, 20 ml (0.23 mole) of concentrated hydrochloric acid and 8.4 g (0.032 mole) of the following diamine compound are charged into a 300 ml beaker, and then the temperature of the solution was lowered to 0° C.:

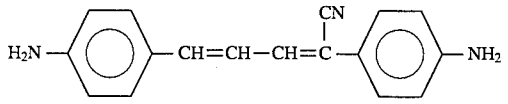

Then, a solution in which 4.6 g (0.067 mole) of sodium nitrite was dissolved in 10 ml of water was dripped into the solution in 10 minutes in such a manner that its temperature was maintained at 5° C. The solution was stirred for 15 minutes, and then it was filtered with a carbon sheet. Then, a solution in which 10.5 g (0.096 mole) of sodium borofluoride was dissolved in 90 ml of water was, while being stirred, dripped into the filtered solution. Then, the deposited borofluoride salt was collected by filtering after it was cleaned with cold water. Finally, the salt was cleaned with acetonitrole and dried under reduced atmospheric pressure at room temperature. The yield was 12.4 g and the ratio of the yield was 84%.

Then, 500 ml of dimethylformamide was charged into a 1 l beaker, and 14.3 g (0.042 mole) of the following coupler was dissolved:

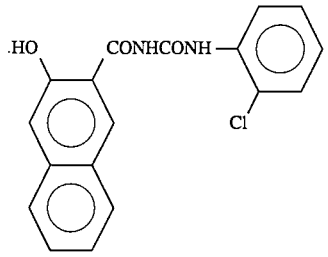

The temperature of the solution was lowered to 5° C., and 9.2 g (0.02 mole) of the foregoing borofluoride salt was dissolved. Then, 5.1 g (0.050 mole) of triethylamine was dripped into the solution in 5 minutes. The solution was stirred for 2 hours, and the deposited pigment was collected by filtering. The pigment was cleaned four times with dimethyl formamide and 3 times with water. Then, it was freeze-dried. The yield was 17.0 g and the ratio of the yield was 90%.

The photosensitive layer of the electrophotographic photosensitive member according to the present invention may be any of the known types. It is preferable to employ function-separated-type photosensitive layer having a charge generating layer containing the disazo pigment represented by formula (1) as a charge generating material, and a charge transporting layer containing a charge transporting material on the charge generating layer.

The charge generating layer can be formed by vacuum-evaporating the disazo pigment according to the present invention on a conductive substrate or by applying, to a conductive substrate, a solution in which the disazo pigment according to the present invention is, together with a binder resin, dispersed in an adequate solvent by a known method. The thickness of the charge generating layer is preferably 5 μm or less and more preferably 0.1 to 1 μm.

The binder resin is selected from any of various insulating resin or organic photoconductive polymers such as polyvinyl butyral, polyvinyl benzal, polyarylate, polycarbonate, polyester, phenoxy resin, cellulose resin, acrylic resin or polyurethane resin. The resin may have a substituent exemplified by halogen atom, an alkyl group, an alkoxy group, a nitro group, a trifluoromethyl group or a cyano group. It is preferable that the quantity of the binder resin be 80 wt % or less of the total weight of the charge generating layer and more preferably 40 wt % or less.

It is preferable that the solvent be a material of a type that dissolves the foregoing resin, but does not dissolve a charge transporting layer and an undercoating layer described later. Specifically, any of the following solvents is selected: ethers such as tetrahydrofuran or 1,4-dioxane; ketones such as cyclohexane or methylethyl ketone; amides such as N,N-dimethylformamide; esters such as methyl acetate or ethyl acetate; aromatic hydrocarbon compounds such as toluene, xylene or monochlorobenzene; alcohols such as methanol, ethanol or 2-propanol; and aliphatic hydrocarbon compounds such as chloroform or methylene chloride.

The charge transporting layer is laminated on or under the charge generating layer and has a function of receiving a charge carriers from the charge generating layer in the presence of an electric field and of transporting the charge carriers. The charge transporting layer can be formed by applying and drying a solution in which the charge transporting material is, together with an adequate binder resin, dissolved in a solvent. The thickness of the charge transporting layer is preferably 5 to 40 μm and more preferably 15 to 30 μm.

The charge transporting materials are classified as electron transporting materials and positive hole transporting materials. The electron transporting material is exemplified by electron absorbing materials such as 2,4,7-trinitrofluorenone, 2,4,5,7-tetranitrofluorenone, chloranil, or tetracyanoquinodimethane; and polymers of the foregoing electron absorbing materials. The positive hole transporting material is exemplified by polycyclic aromatic compounds such as pyrene or anthracene; heterocyclic compounds such as carbazole type, indole type, imidazole type, oxazole type, thiazole type, oxazole type, thiazole type, oxadiazole type, pyrazole type, pyrazoline type, thiadiazole type or triazole type compound; hydrazone compounds such as p-diethylaminobenzaldehyde-N,N-diphenyl hydrazone, or N,N-diphenylhydrazino-3-methylidene-9-ethylcarbazole; styryl compounds such as α-phenyl-4'-N,N-diphenyl aminostilbene or 5-[4-(di-p-tolyllamino)benzilidene]-5H-dibenzo[a, d]cycloheptene; benzidine compounds; triarylmethane compounds; triphenylamine compounds; and a polymer having, in the main or side chain thereof, a group induced from the foregoing compounds. In addition to the foregoing organic charge transporting materials, inorganic materials, such as selenium, selenium-tellurium, amorphous silicon or cadmium sulfide may be used. The foregoing charge transporting materials may be used solely or two or more materials may be used simultaneously.

If the charge transporting material has little or no film-forming properties, an adequate binder resin may be used.

Specifically, any of the following resins may be used insulating resins such as acrylic resin, polyarylate, polyester, polycarbonate, polystyrene, acrylonitrile-styrene copolymer, polyacrylamide, polyamide or chlorinated rubber; or organic photoconductive polymer such as poly-N-vinyl carbazole or polyvinyl anthracene.

Another example of the present invention may be employed which has a structure having a photosensitive layer containing, in the same layer, the disazo pigment represented by formula (1) and the foregoing charge transporting material. In the foregoing case, the charge transporting material may be a charge transporting complex, such as poly-N-vinylcarbazole and trinitrofluorenone. The electrophotographic photosensitive member can be prepared by dispersing and dissolving the disazo pigment and the charge transporting material in an adequate resin solution, by applying the solution on a conductive substrate, and then by drying it. The thickness of the photosensitive layer is preferably 5 to 40 μm and more preferably 15 to 30 μm.

Any of the electrophotographic photosensitive members may contain two or more types of the disazo pigments represented by formula (1) or may contain a known charge generating material together with the foregoing disazo pigment.

The conductive substrate according to the present invention may be made of aluminum, aluminum alloy, copper, zinc, stainless steel, vanadium, molybdenum, chromium, titanium, nickel, indium, gold or platinum. Any of the following may also be employed: a plastic (polyethylene, polypropylene, polyvinyl chloride, polyethylene terephthalate or acryl resin) substrate having a film formed by vacuum-evaporating the foregoing metal or alloy; a substrate manufactured by disposing a layer containing an adequate binder and conductive particles (for example, carbon black or silver particles) dispersed therein on the foregoing plastic, a metal or alloy substrate; or a substrate manufactured by impregnating plastic or paper member with conductive particles. The conductive substrate may have a drum, sheet or belt shape.

In the present invention, an undercoating layer having a barrier function and an adhesion function may be provided between the conductive substrate and the photosensitive layer. It is preferable that the thickness of the undercoating layer be 5 μm or less and more preferably 0.1 to 3 μm. The undercoating layer may be formed of any of the following materials: casein, polyvinyl alcohol, nitrocellulose, polyamide (nylon 6, nylon 66, nylon 610, copolymer nylon or alkoxy methylated nylon), polyurethane or aluminum oxide.

In order to protect the photosensitive layer from adverse external mechanical or chemical influences, a protective layer may be provided on the photosensitive layer. The protective layer is a resin layer or a resin layer containing conductive particles or the charge transporting material.

The electrophotographic photosensitive member according to the present invention can be used widely in electrophotographic fields, for example, in a laser beam printer, a CRT printer, an LED printer, a liquid crystal printer, a laser plate-making apparatus or a facsimile machine.

FIG. 1 is a schematic view which illustrates the structure of the electrophotographic apparatus having the process cartridge with the electrophotographic photosensitive member according to the present invention.

Referring to FIG. 1, a drum type electrophotographic photosensitive member 1 according to the present invention is rotatable around a shaft 2 in the direction indicated by the arrow at a predetermined circumferential speed. During rotation, the electrophotographic photosensitive member 1 is, on the surface thereof, uniformly charged with positive or negative predetermined potential by a primary charging means 3. The electrophotographic photosensitive member 1 is irradiated with image exposing light 4 emitted from a slit or laser beam scanning image exposing means (not shown). Thus, a latent image is gradually formed on the surface of the electrophotographic photosensitive member 1.

The formed latent image is developed into a toner image by a developing means 5, and the developed toner image is, by a transfer means 6, gradually transferred on to a transferring material 7 fed from a paper feeder (not shown) to a space between the electrophotographic photosensitive member 1 and the transfer means 6, the transportation of the transferring material 7 being performed in synchronization with the rotation of the electrophotographic photosensitive member 1.

The transferring material 7 having the image transferred thereto is separated from the surface of the electrophotographic photosensitive member 1 and introduced into an image fixing means 8 so that the image is fixed. Thus, a copy is printed and made available externally of the apparatus.

The surface of the electrophotographic photosensitive member 1 is, after image transferring, subjected to a process of removing the residual toner by a cleaning means 9 so that the surface of the electrophotographic photosensitive member 1 is cleaned. Then, the electrophotographic photosensitive member 1 is discharged by pre-exposure light 10 emitted from a pre-exposing means (not shown). Thus, the electrophotographic photosensitive member 1 can be used repeatedly. In the case where the primary charging means 3 is a contact charging means using a charging roller or the like rather than the illustrated corona charger, the pre-exposure step can be omitted.

In the present invention, a plurality of components may be integrated to form a process cartridge, the components being selected from a group consisting of the electrophotographic photosensitive member 1, the primary charging means 3, the developing means 5 and the cleaning means 9. The process cartridge is detachably mounted on the body of an electrophotographic apparatus such as a copying machine or a laser beam printer. For example, at least one of the primary charging means 3, the developing means 5 and the cleaning means 9 is integrated with the electrophotographic photosensitive member 1 to be formed into a process cartridge 11 that can be attached/detached from the apparatus body by using rails 12 disposed in the apparatus body.

In a case where the electrophotographic apparatus is a copying machine or a printer, image exposing light 4 is light reflected by or transmitted through an original document or light emitted due to the following steps: an original document is read by a sensor and formed into signals; and then in response to such signals a laser beam is scanned, an LED array is operated or a liquid crystal shutter array is operated.

Figure 2:
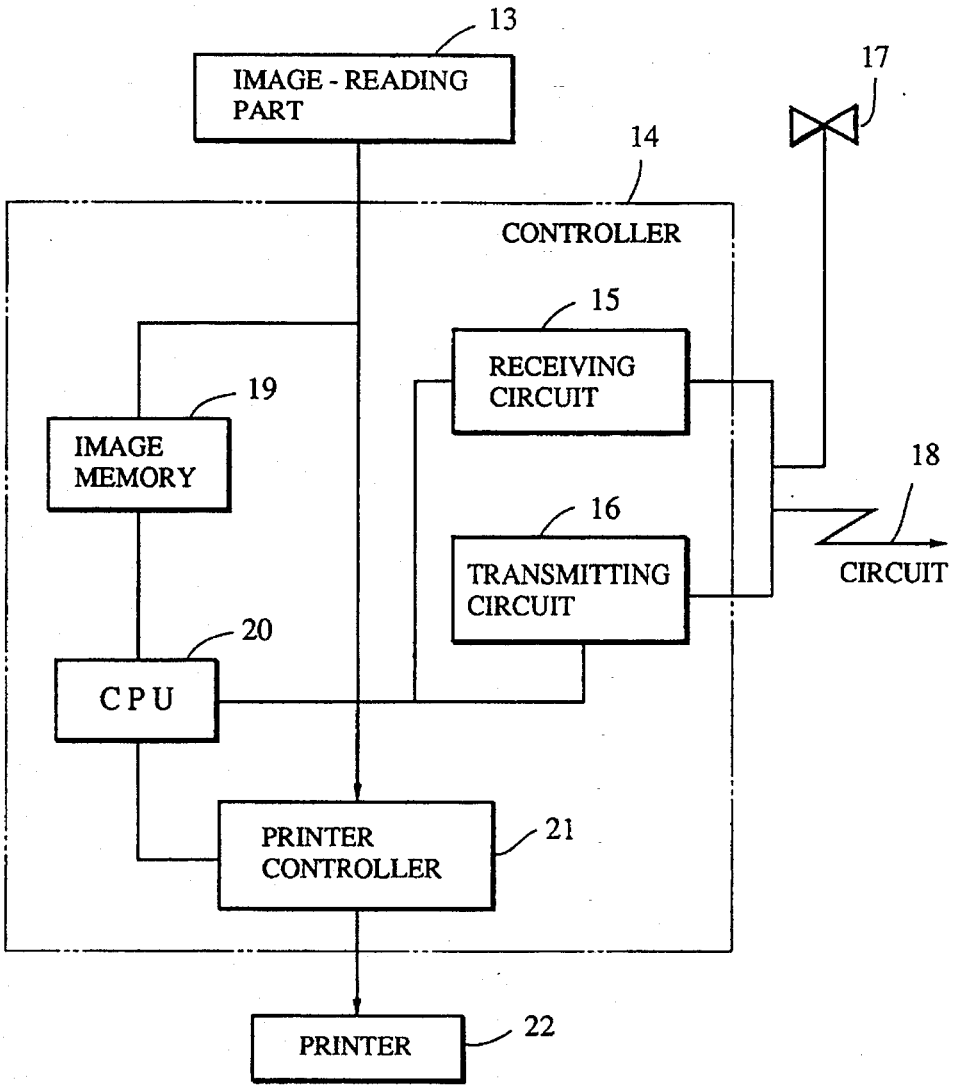
FIG. 2 is block diagram which illustrates a facsimile machine having the electrophotographic photosensitive member according to the present invention.

If the electrophotographic apparatus is a printer for a facsimile machine, image exposing light 4 is exposing light for printing received data. FIG. 2 is a block diagram which illustrates an example of the foregoing structure.

A controller 14 controls an image-reading part 13 and a printer 22. The .controller 14 is controlled by a CPU 20. Data read by the image-reading part 13 is transmitted to connected station through a transmitting circuit 16. Data received from the connected station is supplied to the printer 22 through a receiving circuit 15. An image memory 19 stores a predetermined image data. A printer controller 21 controls the printer 22. Reference numeral 17 represents a telephone set.

An image (image information supplied from a remote terminal unit connected through a line) received from a line 18 is demodulated by the receiving circuit 15. Then, image information is decoded by the CPU 20 and sequentially stored in the image memory 19. When at least one page image has been stored in the image memory 19, the page image is printed or recorded. The CPU 20 reads image information for one page from the image memory 19 and transmits decoded image information for one page to the printer controller 21. When the printer controller 21 has received image information for one page, the printer controller 21 controls the printer 22 to record image information for one page. The CPU 20 receives information of next page during the printing operation performed by the printer 22. Thus, an image is received and printed.

Examples of the present invention will now be described.

EXAMPLE 1

A solution, in which 5 g of methoxy methylated nylon (number average molecular weight of 32,000) and 10 g of alcohol-soluble copolymer nylon (number average molecular weight of 29,000) were dissolved in 95 g of methanol, was applied to an aluminum substrate by using a wire bar and dried. Thus, an undercoating base layer having a thickness of 1 μm was formed.

Then, 5 g of a disazo pigment shown as Pigment Example 1 was added to a solution in which 2 g of butyral resin (butyralation degree of 63 mol %, a number average molecular polymerization degree of 2,000) was dissolved in 95 g of cyclohexane. Then, a sand mill was used to disperse the components for 20 hours. The dispersed solution was applied on the undercoating layer by using a wire bar and dried. Thus, a charge generating layer having a thickness of 0.2 μm was formed.

Then, a solution in which 5 g of a styryl compound represented by the following formula:

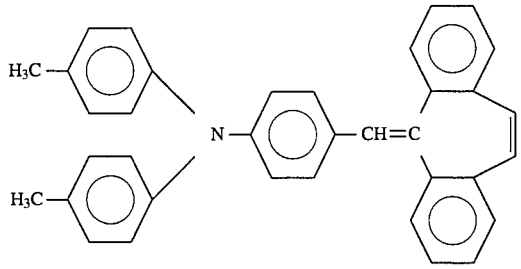

and 5 g of polymethylmethacrylate (a number average molecular weight of 100,000) were dissolved in 40 g of chlorobenzene, was applied on the charge generating layer by using a wire bar and dried. Thus, a charge transporting layer having a thickness of 20 μm was formed.

The electrophotographic photosensitive member obtained was subjected to corona discharge of −5 KV by using an electrostatic copying paper testing apparatus (SP-428 manufactured by Kawaguchi Denki) to become negatively charged and was left in a dark place for one second. Then, the electrophotographic photosensitive member was exposed to light having an illuminance of 10 lux emitted from a halogen lamp so that its charging characteristics were evaluated. As the charging characteristics, the surface potential $V_0$ immediately after the charging operation and the exposure quantity, i.e., sensitivity ($E_{1/2}$), required to decay to half the surface potential after the electrophotographic photosensitive member being left in a dark place for one second were measured. The results are shown in Table 1.

EXAMPLES 2 TO 10

Electrophotographic photosensitive members were manufactured and evaluated as in Example 1, except for using disazo pigment shown in Table 1 in place of Pigment Example 1. The results are shown in Table 1.

TABLE 1

| Example | Pigment Example | V0 (−V) | E½ (lux · sec) |
|---|---|---|---|
| 1 | 1 | 690 | 1.3 |
| 2 | 4 | 700 | 2.1 |
| 3 | 6 | 705 | 1.2 |
| 4 | 12 | 685 | 1.9 |
| 5 | 15 | 690 | 0.9 |
| 6 | 19 | 695 | 2.5 |
| 7 | 21 | 705 | 2.5 |
| 8 | 24 | 695 | 1.8 |
| 9 | 26 | 695 | 1.6 |
| 10 | 28 | 700 | 0.9 |

COMPARATIVE EXAMPLES 1 AND 2

Electrophotographic photosensitive members were manufactured and evaluated as in Example 1 except for using the following disazo pigments in place of Pigment Example 1. The results are shown in Table 2.

Comparative Pigment Example 1 (disazo pigment disclosed in Japanese Patent Laid-Open No. 61-231052)

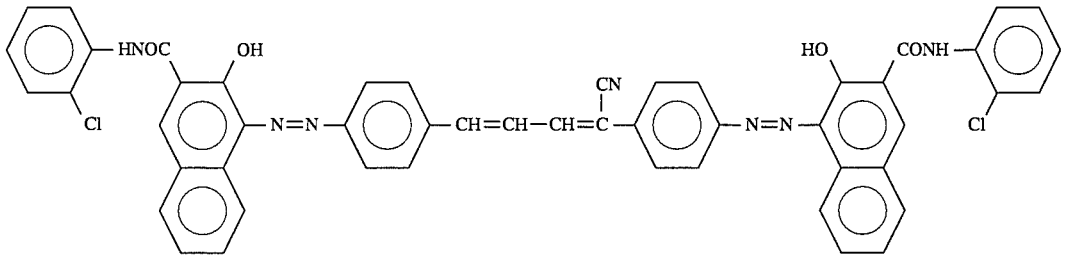

Comparative Pigment Example (disazo pigment disclosed in Japanese Patent Laid-Open No. 62-267363)

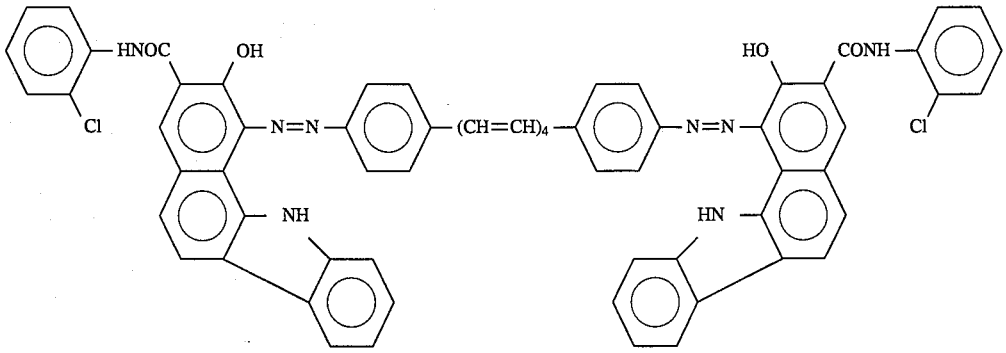

TABLE 2

| Comparative Example | Comparative Pigment Example | V0 (−V) | E½ (lux · sec) |
|---|---|---|---|
| 1 | 1 | 700 | 4.6 |
| 2 | 2 | 690 | 3 |

As can be understood from the results of Table 1, each of the constant electrophotographic photosensitive members have sufficient charging performance and excellent sensitivity. In contrast, the comparative disazo pigment provided reduced sensitivity.

EXAMPLE 11

The electrophotographic photosensitive member manufactured in Example 1 was applied to a cylinder of an electrophotographic apparatus comprising a −6.5 KV corona charger, an exposing optical system, a developing means, a transferring charger, a discharging exposing optical system and a cleaner.

The initial dark potential $V_D$ and light potential $V_L$ were each set to about −700 V and −200 V. The electrophotographic photosensitive member was used repeatedly 5,000 times to measure a changed quantity $\Delta V_D$ in the dark part potential and a changed quantity $\Delta V_L$ in the light potential part before and after repeated use in order to evaluate durability. The results are shown in Table 3. The negative sign of the changed quantity means that the absolute value of the potential was reduced, while the positive sign means that the absolute value of the potential was enhanced.

EXAMPLES 12 TO 15

Electrophotographic photosensitive members were evaluated as in Example 11 except for using the electrophotographic photosensitive members manufactured in Examples 3, 5, 8 and 10 in place of the electrophotographic photosensitive member manufactured in Example 1. The results are shown in Table 3.

TABLE 3

| Example | ΔVD (V) | ΔVL (V) |
|---|---|---|
| 11 | −5 | +5 |
| 12 | 0 | +5 |
| 13 | −10 | 0 |
| 14 | −5 | +10 |
| 15 | −10 | −5 |

COMPARATIVE EXAMPLES 3 AND 4

Electrophotographic photosensitive members were evaluated as in Example 11 except for using the electrophotographic photosensitive members manufactured in Comparative Examples 1 and 2 in place of the electrophotographic photosensitive member manufactured in Example 1. The results are shown in Table 4.

TABLE 4

| Comparative Example | ΔVD (V) | ΔVL (V) |
|---|---|---|
| 3 | −30 | +35 |
| 4 | −25 | −15 |

As can be understood from the results of Examples 11 to 15 and the Comparative Examples 3 and 4, the electrophotographic photosensitive member according to the present invention has excellent potential stability.

EXAMPLE 16

A 0.5 μm thick undercoating layer of polyvinyl alcohol (number average molecular weight of 22,000) was formed on an aluminum surface evaporated onto a polyethylene terephthalate film.

5 g of disazo pigment shown as Pigment Example 9 was added to a solution in which 2 g of butyral resin (butyralation degree of 63 mol %, number average molecular polymerization degree of 2,000) was dissolved in 95 g of cyclohexane, the solution being dispersed for 20 hours by using a sand mill. The dispersed solution was applied onto the foregoing undercoating layer and dried. Thus, a charge generating layer having a thickness of 0.20 μm was formed.

Then, a solution in which 5 g of a hydrazone compound represented by the following formula:

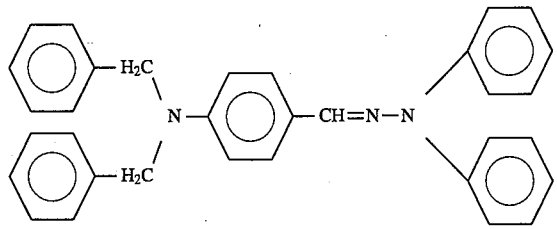

and 5 g of polycarbonate (number average molecular weight of 55,000) were dissolved in 40 g of tetrahydrofuran, was applied onto the charge generating layer and dried. Thus, a charge transporting layer having a thickness of 20 μm was formed.

The charging characteristics and the durability of the electrophotographic photosensitive member obtained were evaluated as in Examples 1 and 11. The results were as follows:

$V_0$: −695 V $E_{1/2}$: 2.0 lux·sec $\Delta V_D$: 0 V $\Delta V_L$: +10 V

EXAMPLE 17

A 0.5 μm, thick undercoating layer of polyvinyl alcohol (number average molecular weight of 22,000) was formed on an aluminum surface evaporated onto a polyethylene terephthalate film.

5 g of a disazo pigment shown as Pigment Example 25 was added to a solution in which 2 g of poly-p-fluorovinyl benzal (benzalation degree of 75 mol % or more, number average molecular weight of 90,000) was dissolved in 95 g of tetrahydrofuran, the solution being dispersed for 20 hours by using a sand mill. The dispersed solution was applied onto the foregoing undercoating layer and dried. Thus, a charge generating layer having a thickness of 0.20 μm was formed.

Then, a solution in which 5 g of a triarylamine compound represented by the following formula:

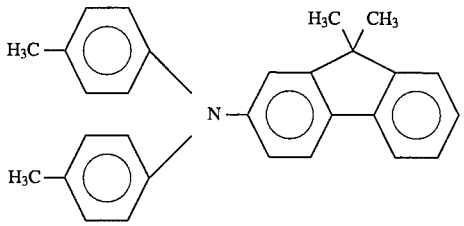

and 5 g of polycarbonate (number average molecular weight of 55,000) were dissolved in 40 g of chlorobenzene, was applied on the charge generating layer and dried. Thus, a charge transporting layer having a thickness of 20 μm was formed.

The charging characteristics and the durability of the electrophotographic photosensitive member obtained were evaluated as in Examples 1 and 11. The results are as follows:

$V_0$: −690 V $E_{1/2}$: 2.3 lux·sec $\Delta V_D$: 0 V $\Delta V_L$: +5 V

EXAMPLE 18

An electrophotographic photosensitive member was manufactured and evaluated as in Example 17 except for forming the charge generating layer in an inverse order. The polarity of charging was, however, made positive. The results were as follows:

$V_0$: +705 V $E_{1/2}$: 2.6 lux·sec $\Delta V_D$: +5 V $\Delta V_L$: +10 V

EXAMPLE 19

An undercoating layer and a charge generating layer were formed as in Example 1.

Then, a solution in which 5 g of 2,4,7-trinitro-9-fluorenone and 5 g of polycarbonate (weight average molecular weight of 30,000) were dissolved in 50 g of tetrahydrofuran, was applied on the charge generating layer using a wire bar and dried. Thus, a charge transporting layer having a thickness of 18 μm was formed. The electrophotographic photosensitive member obtained was evaluated as in to Example 1. The polarity of charging was, however, positive. The results were as follows:

$V_0$: +695 V $E_{1/2}$: 2.0 lux·sec

EXAMPLE 20

0.5 g of a disazo pigment shown as Pigment Example 11 was added to 9.5 g of cyclohexane and the mixture was dispersed by using a paint shaker for 5 hours. Then, a solution in which 5 g of the charge transporting material of Example 1 and 5 g of polycarbonate (weight average molecular weight of 80,000) were dissolved in 40 g of tetrahydrofuran, was added to the foregoing dispersed solution and further shaken for one hour. The solution obtained was applied onto an aluminum substrate using a wire bar and dried. Thus, a photosensitive layer having a thickness of 20 μm was formed. The electrophotographic photosensitive member obtained was evaluated as in to Example 1. The charging polarity was, however, made positive. The results were as follows:

$V_0$: +700 V $E_{1/2}$: 2.0 lux·sec

EXAMPLE 21

A dispersed solution was obtained by dispersing, with a sand mill apparatus with ϕ1 glass beads for 2 hours, 50 g of titanium oxide powder coated with tin oxide containing 10% antimony oxide, 25 g of resol-type phenol resin, 20 g of methyl cellosolve, 5 g of methanol and 0.002 g of silicon oil (polydimethyl siloxane-polyoxyalkylene copolymer (weight average molecular weight of 3,000). The dispersed solution was applied onto an aluminum cylinder (ϕ80 mm×360 mm) by dip coating and dried at 140° C. for 30 minutes. Thus, a conductive layer having a thickness of 20 μm was formed.

Then, a solution in which 5 g of a tetraelement type (6-66-610-12) polyamide copolymer (weight average molecular weight of 30,000) was dissolved in a mixture solvent of 70 g of methanol and 25 g of butanol, was applied onto the conductive layer by dip coating and dried. Thus, an undercoating layer having a thickness of 1 μm was formed.

Then, a dispersed solution for a charge generating layer as in Example 10 was applied on the undercoating layer by dip coating and dried. Thus, a charge generating layer having a thickness of 0.3 μm was formed.

Then, a solution in which 10 g of a triarylamine compound represented by the following formula:

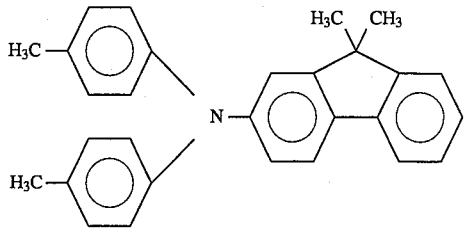

and 10 g of polycarbonate (weight average molecular weight of 20,000) were dissolved in 60 parts of chlorobenzene was applied onto the charge generating layer by dip coating and dried at 120° C. for one hour. Thus, a charge transporting layer having a thickness of 20 μm was formed.

The electrophotographic photosensitive member obtained was mounted on a laser beam printer (LBP-SX manufactured by Canon), the dark part potential was set to −700 V. An exposure quantity of laser beams (wavelength of −802 nm) required to make the light part potential to be −150 V was measured to evaluate sensitivity. Each of the initial dark part potential and the light part potential of the printer were set to −700 V and −150 V, and continuous image forming of 5,000 sheets was performed with the printer. The charged quantity in the dark part potential ($\Delta V_D$) and the changed quantity in the light part potential ($\Delta V_L$) before and after the image forming operation, were measured to evaluate durability. The results are as follows. The positive and negative signs of the changed potential are used as in Example 11.

Sensitivity: 0.25 μJ/cm$^2$ $\Delta V_D$: 0 V $\Delta V_L$: +5 V

Although the invention has been described in a preferred form with a certain degree of particularity, it is to be understood that the present disclosure of the preferred form can be changed in details of construction and combination and arrangement of parts without departing from the spirit and scope of the invention as hereinafter claimed. The invention is therefore not to be limited except as set forth in the following claims:

What is claimed is:

1. An electrophotographic photosensitive member comprising:

a conductive substrate and a photosensitive layer thereon, said photosensitive layer containing a charge transporting material and a disazo pigment represented by the following formula (1):

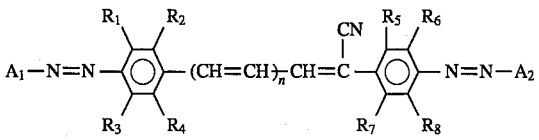

wherein $R_1$ to $R_8$ are the same or different and are each a hydrogen atom, a halogen atom, an alkyl group or an alkoxy group, n is a positive integer, $A_1$ and $A_2$ are the same or different and are each a coupler residual groups having a phenolic hydroxyl group, and at least one of $A_1$ and $A_2$ is a coupler residual group represented by the following formula (2):

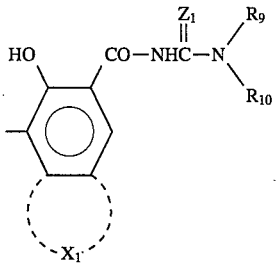

wherein $X_1$ is a residual group forming a polycyclic aromatic ring or a heterocyclic ring by condensing with a benzene ring, $R_9$ and $R_{10}$ are the same or different and are each a hydrogen atom, an alkyl group, an aryl group, an aralkyl group, a heterocyclic group or a residual group forming a cyclic amino by bonding together, and $Z_1$ is an oxygen atom or a sulfur atom.

2. An electrophotographic photosensitive member according to claim 1, wherein $R_1$ to $R_8$ are hydrogen atoms.

3. An electrophotographic photosensitive member according to claim 1 or 2, wherein n is an integer from 1 to 6.

4. An electrophotographic photosensitive member according to claim 1, wherein both $A_1$ and $A_2$ are coupler residual groups represented by formula (2).

5. An electrophotographic photosensitive member according to claim 1 or 4, wherein $X_1$ is a residual group forming a benzocarbazole ring by condensing with a benzene ring.

6. An electrophotographic photosensitive member according to claim 1 or 2, wherein said photosensitive layer comprises a charge generating layer containing said disazo pigment as a charge generating material on said conductive substrate and a charge transporting layer on said charge generating layer.

7. A process cartridge comprising:

means selected from the group consisting of at least one electrophotographic photosensitive member, a charging means, a developing means and a cleaning means;

said electrophotographic photosensitive member comprising a conductive substrate and a photosensitive layer thereon, said photosensitive layer containing a charge transporting material and a disazo pigment represented by the following formula (1):

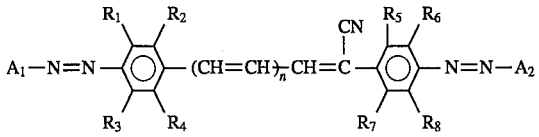

wherein $R_1$ to $R_8$ are the same or different and are each a hydrogen atom, a halogen atom, an alkyl group or an alkoxy group, n is a positive integer, $A_1$ and $A_2$ are the same or different and are each a coupler residual group having a phenolic hydroxyl group, and at least one of $A_1$ and $A_2$ is a coupler residual group represented by the following formula (2):

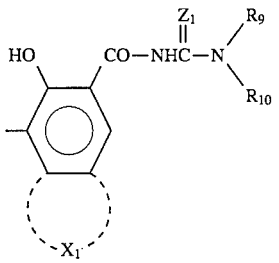

(2)

wherein $X_1$ is a residual group forming a polycyclic aromatic ring or a heterocyclic ring by condensing with a benzene ring, $R_9$ and $R_{10}$ are the same or different and are each a hydrogen atom, an alkyl group, an aryl group, an aralkyl group, a heterocyclic group or a residual group forming a cyclic amino group by bonding together, and $Z_1$ is an oxygen atom or a sulfur atom; and said electrophotographic photosensitive member and said at least one means being integrally supported so as to be detachable from a body of an electrophotographic apparatus.

8. An electrophotographic apparatus comprising:

an electrophotographic photosensitive member, charging means, image exposing means, developing means, and transfer means, said electrophotographic photosensitive member comprising a conductive substrate and a photosensitive layer thereon, said photosensitive layer containing a charge transporting material and a disazo pigment represented by the following formula (1):

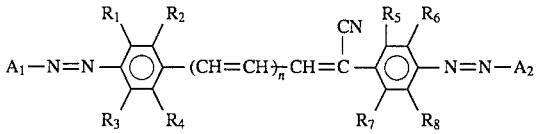

(1)

wherein $R_1$ to $R_8$ are the same or different and are each a hydrogen atom, a halogen atom, an alkyl group or an alkoxy group, n is a positive integer, $A_1$ and $A_2$ are the same or different and are each a coupler residual group having a phenolic hydroxyl group, and at least one of $A_1$ and $A_2$ is a coupler residual group represented by the following formula (2):

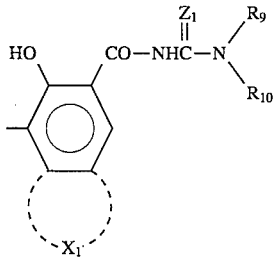

(2)

wherein $X_1$ is a residual group forming a polycyclic aromatic ring or a heterocyclic ring by condensing with a benzene ring, $R_9$ and $R_{10}$ are the same or different and are each a hydrogen atom, an alkyl group, an aryl group, an aralkyl group, a heterocyclic group or a residual group forming a cyclic amino group by bonding together, and $Z_1$ is an oxygen atom or a sulfur atom.

* * * * *

UNITED STATES PATENT AND TRADEMARK OFFICE

CERTIFICATE OF CORRECTION

PATENT NO. : 5,622,799

DATED : April 22, 1997

INVENTORS : KOICHI SUZUKI ET AL.

It is certified that error appears in the above-identified patent and that said Letters Patent is hereby corrected as shown below:

COLUMN 2
Line 67, "atoms," should read --atom,-- and "groups" should read --group--.

COLUMN 3
Line 1, "groups," should read --group,--;
Line 5, "(2)" should read --(2):--;
Line 48, "trienyl" should read --thienyl--.

COLUMN 5
Line 12, "and (7)" should read --(7)--.

COLUMN 6
Line 9, "1" should read --(1)--.

COLUMN 23
Line 33, "acetonitrole" should read --acetonitrile--.

COLUMN 24
Line 31, "a" (second occurrence) should be deleted.
Line 50, "oxazole type, thiazole type" should be deleted.

COLUMN 25
Line 1, "used" should read --used:--;

COLUMN 26
Line 58, ".controller" should read --controller--.

UNITED STATES PATENT AND TRADEMARK OFFICE

CERTIFICATE OF CORRECTION

PATENT NO. : 5,622,799

DATED : April 22, 1997

INVENTORS : KOICHI SUZUKI ET AL.

It is certified that error appears in the above-identified patent and that said Letters Patent is hereby corrected as shown below:

COLUMN 29

Table 2, "3" should read -3.9--;

Table 3, "ΔVD" should read --$\Delta V_D$-- and "ΔVL" should read --$\Delta V_L$--.

COLUMN 30

Table 4, "ΔVD" should read --$\Delta V_D$-- and "ΔVL" should read --$\Delta V_L$--.

COLUMN 31

Line 14, "μm," should read --μm--.

COLUMN 32

Line 51, "(" should read --,--.

UNITED STATES PATENT AND TRADEMARK OFFICE

CERTIFICATE OF CORRECTION

PATENT NO. : 5,622,799

DATED : April 22, 1997

INVENTORS : KOICHI SUZUKI ET AL.

It is certified that error appears in the above-identified patent and that said Letters Patent is hereby corrected as shown below:

COLUMN 33

Line 29, "changed" should read --charged--;
Line 33, "changed" should read --charged--;
Line 63, "groups" should read --group--.

Signed and Sealed this

Twentieth Day of January, 1998

*Attest:*

*Attesting Officer*

BRUCE LEHMAN

*Commissioner of Patents and Trademarks*